US008689902B2

(12) United States Patent
Puura et al.

(10) Patent No.: US 8,689,902 B2
(45) Date of Patent: Apr. 8, 2014

(54) METHOD AND EQUIPMENT FOR DISPLAYING DRILL HOLES AND METHOD FOR DIRECTING DRILL ROD WHEN HOLES ARE DRILLED INTO ROCK

(75) Inventors: Jussi Puura, Tampere (FI); Markus Saarela, Tampere (FI); Jouko Muona, Nokia (FI); Tommi Säleniemi, Tampere (FI); Tatu Hautala, Tampere (FI); Jukka Osara, Tampere (FI); Pertti Koivunen, Tampere (FI); Pekka Laine, Toijala (FI)

(73) Assignee: Sandvik Mining and Construction Oy, Tampere (FI)

( * ) Notice: Subject to any disclaimer, the term of this patent is extended or adjusted under 35 U.S.C. 154(b) by 598 days.

(21) Appl. No.: 12/997,456

(22) PCT Filed: Jun. 3, 2009

(86) PCT No.: PCT/FI2009/050468

§ 371 (c)(1),
(2), (4) Date: Dec. 10, 2010

(87) PCT Pub. No.: WO2009/150294

PCT Pub. Date: Dec. 17, 2009

(65) Prior Publication Data

US 2011/0100711 A1 May 5, 2011

(30) Foreign Application Priority Data

Jun. 13, 2008 (FI) ..... 20085587

(51) Int. Cl.
*E21B 44/00* (2006.01)

(52) U.S. Cl.
USPC ..... 175/40; 175/24; 175/108

(58) Field of Classification Search
USPC ..... 175/24, 27, 108, 40; 702/9; 700/182
See application file for complete search history.

(56) References Cited

U.S. PATENT DOCUMENTS

| | | | | |
|---|---|---|---|---|
| 4,979,575 | A * | 12/1990 | Strom et al. | 173/1 |
| 6,293,355 | B1 * | 9/2001 | Koivunen et al. | 175/26 |
| 6,460,630 | B2 * | 10/2002 | Ahtola et al. | 175/45 |
| 6,957,707 | B2 * | 10/2005 | Koivunen et al. | 175/27 |
| 8,392,014 | B2 * | 3/2013 | Saleniemi et al. | 700/182 |

FOREIGN PATENT DOCUMENTS

| | | |
|---|---|---|
| JP | 10-096627 | 4/1998 |
| WO | WO 2007/026052 | 3/2007 |

* cited by examiner

*Primary Examiner* — Nicole Coy
(74) *Attorney, Agent, or Firm* — Morgan, Lewis & Bockius LLP

(57) ABSTRACT

A method and equipment for displaying holes to be drilled when drilling holes into rock with a rock-drilling rig having control equipment and a display belonging thereto and measuring means for defining the direction and position of a drill rod, by using a pre-designed drilling plan defined in a three-dimensional coordinate system, in which a starting point (19*a* to 21*a*) and end point (19*b* to 21*b*) is defined for each hole to be drilled. A base plane running through the end point (19*b* to 21*b*) of the hole and parallel to the projection plane is defined for each hole (19 to 21), and a projection of the intersection of a hole or its extension created when drilling in accordance with the current location of the drill rod and the defined base plane is displayed with a graphical location symbol on the projection plane.

22 Claims, 2 Drawing Sheets

Prior Art
Fig. 3a
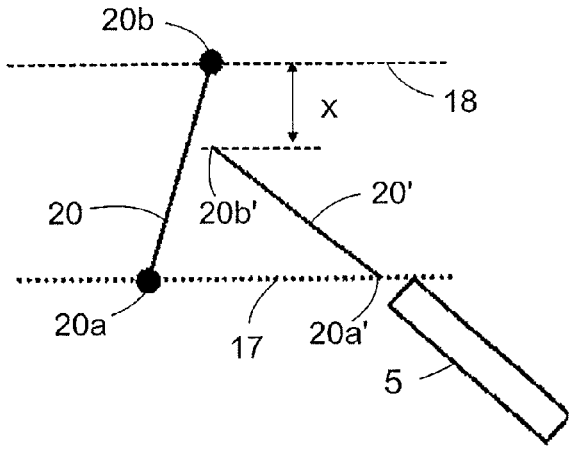
Prior Art
Fig. 3b
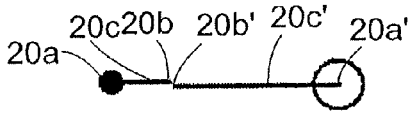
Fig. 4a
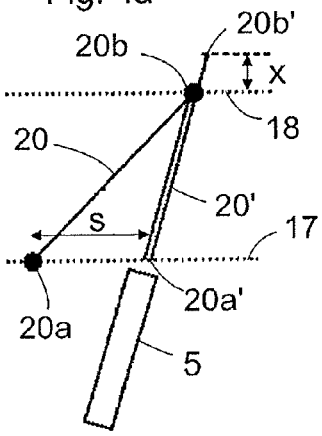
Fig. 4c
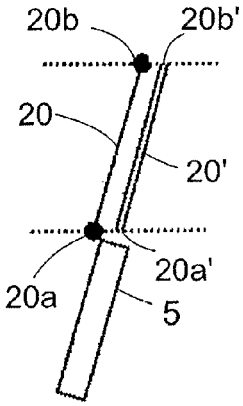
Fig. 4e
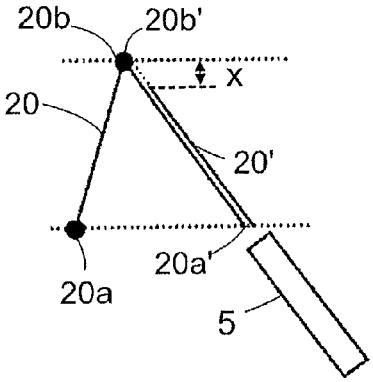
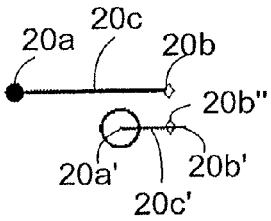
Fig. 4b
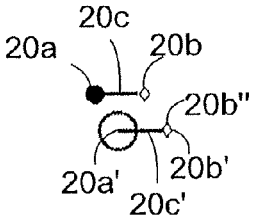
Fig. 4d
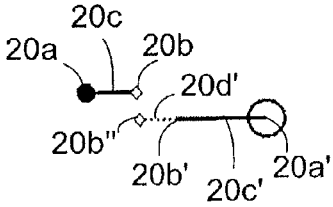
Fig. 4f

METHOD AND EQUIPMENT FOR DISPLAYING DRILL HOLES AND METHOD FOR DIRECTING DRILL ROD WHEN HOLES ARE DRILLED INTO ROCK

CROSS REFERENCE TO RELATED APPLICATIONS

This application is the National Stage of International Application No. PCT/FI2009/050468, filed Jun. 3, 2009, and claims benefit of Finnish Application No. 20085587 filed Oct. 17, 2008.

BACKGROUND OF THE INVENTION

The invention relates to a method for displaying holes to be drilled when drilling holes into rock with a rock-drilling rig having control equipment and a display belonging thereto, and measuring means for defining the direction and position of the drill rod, by using a pre-designed drilling plan that is defined using a three-dimensional coordinate system relative to the rock and that defines for each hole to be drilled a starting point and an end point in accordance with the direction of each planned hole, and in which method, for drilling the hole, a projection according to the drilling plan of the planned hole is displayed on the display of the control equipment on a transverse projection plane of the holes to be drilled, and a projection of the hole created when drilling according to the current position of the drill rod on said projection plane in accordance with a target length set for the hole.

The invention further relates to a method for directing a drill rod when drilling holes into rock with a rock-drilling rig having control equipment and a display belonging thereto, and measuring means for defining the direction and position of the drill rod, by using a pre-designed drilling plan that is defined using a three-dimensional coordinate system relative to the rock, the method defining for each hole to be drilled in the coordinate system a starting point and an end point in accordance with the direction and length of each planned hole and, for drilling the hole, a projection of the planned hole is displayed on the display of the control equipment as a line segment on a transverse projection plane of the holes and, correspondingly, a projection of the actual hole created, when drilling according to the current position of the drill rod, as a line segment on said projection plane when drilling in accordance with a target length set for the hole.

The invention further relates to equipment for displaying holes to be drilled when drilling holes into rock with a rock-drilling rig having control equipment and a display belonging thereto, and measuring means for defining the direction and position of the drill rod, by using a pre-designed drilling plan that is defined using a three-dimensional coordinate system relative to the rock and that defines for each hole to be drilled in the coordinate system a starting point and an end point in accordance with the direction and length of each planned hole, and display means for displaying on the display of the control equipment a projection of the planned hole as a line segment on a transverse projection plane of the holes and, correspondingly, a projection of the actual hole created when drilling according to the current position of the drill rod as a line segment on said projection plane when drilling in accordance with a target length set for the hole.

Today, in rock drilling a great number of holes are drilled with automatic tunnel-boring machines whose operation is based on a pre-designed drilling plan and automatic control. For performing and monitoring the drilling, the drilling plan, the positions of the drilling rig booms and the relationship of the actual drilling of holes with the plan is typically displayed on a graphical user interface of the drilling rig on a display by means of a 2D-projection view. The view displayed on the display is utilised, for instance, in positioning the drilling boom to the planned hole so that the directional symbol of the boom is exactly on top of the symbol of the planned hole.

This projection uses various simplifications, such as a fixed 5-m drilling length or an actual planned length of the drill hole. However, in known embodiments it has been necessary for the positioning of the boom, for instance, to use a fixed length and, on the other hand, in monitoring the drilling, it has been necessary to use a projection according to the actual drilling length. This projection variation has complicated the work of the user.

When using a projection corresponding to a fixed drilling length, the problem is that the relationships of the end points of the holes do not correspond to the actual situation. Correspondingly, when making a projection according to the actual length, the planned or actual holes are not comparable, and holes of different lengths and different angles may have completely similar projections on a 2D plane. Also, if a projection according to the actual hole length has not been combined with a boom symbol projection on the basis of the length of the nearest hole, the presentation is misleading to a user, since parallel and equal-length projection lines on the display do not guarantee that the planned and actual holes are in fact parallel.

A significant problem in both projection manners is also that a user not knowledgeable in trigonometry easily gets the misconception that if the hole and the end points of the boom symbols meet on the display, the actual and intended end points of the hole also meet. However, this is not always correct, and the problem occurs in special situations, in which the hole to be drilled cannot be started at the planned starting point.

BRIEF DESCRIPTION OF THE INVENTION

It is an object of the present invention to provide a method and equipment for displaying holes planned in a drilling diagram and holes to be drilled and/or already drilled on the display of the control equipment of a rock-drilling rig, with which the relationship and relative position of the planned hole and the corresponding drilled hole is better displayed. Another object of the invention is to provide a method for directing a drill rod, with which a user may easily direct the drill rod in a desired manner so that the end point of the actual hole is at the end point of the planned hole at a sufficient accuracy.

The method of the invention for displaying holes to be drilled is characterised by a) defining for each hole a base plane running through the end point of the hole and parallel to the projection plane, and b) displaying with a graphical locating symbol a projection of the intersection between a hole or its extension created when drilling according to the current position of the drill rod and the defined base plane on the projection plane.

The equipment of the invention for displaying holes to be drilled is characterised in that the display means are arranged to a) define for each hole a base plane running through the end point of the hole and parallel to the projection plane, b) display with a graphical locating symbol in the projection an intersection between a hole or its extension created when drilling according to the current position of the drill rod and the base plane on defined for the hole.

The method of the invention for directing a drill rod is characterised by a) defining for each hole a base plane running through the end point of the hole and parallel to the transverse plane, b) displaying with a graphical locating symbol in the projection the intersection between a hole or its extension created when drilling according to the current position of the drill rod and the defined base plane, and c) if the intersection of the projection of the hole created during drilling or the parallel extension thereof differs from the end point of the planned hole, performing one or both of the following operations d) directing the drill rod until said end point of the planned hole and the symbol of the intersection of the hole created during drilling and its base plane are at the same place on the display, e) altering the drilling length of the hole created during drilling so that on the display it ends at said intersection.

The essential idea of the invention is that when drilling on the basis of the planned hole and the position of the drill rod and when displaying the projections of the actual created hole on the same projection plane, the location of the end point of the planned hole is also illustrated to the user in relation to the location of the end point of the hole to be actually created, whereby the user sees before drilling the hole, whether the hole to be created is suitable with respect to the plan.

An advantage of the invention is that with the 2D projection of the holes, it is possible to display on the display screen the actual situation of the starting and end points of both the planned and drilled hole at a sufficient accuracy. The projections of the actual holes are mutually comparable, because a common reference depth based on the length of the round is used for them.

When a feed device together with a drill rod is positioned in such a manner that the projection lines of the target hole and planned hole are parallel and the distance between the starting points and locating marks is of the same length, a hole parallel to the planned hole is always drilled. Correspondingly, it is also possible to drill a hole that is parallel to a previously drilled actual hole. Similarly, an actual hole created when drilling in accordance with the operations will essentially end at the end point of the planned hole.

The positioning of the drill rod may also be done independent of the starting point of the hole so that when drilling the hole to a correct depth, the actual end point of the drilled hole corresponds at a sufficient accuracy to the end point of the planned hole. Further, graphical presentation provides the user with an illustrative way of adjusting the hole depth, if the hole seems to become too short or too long in comparison with what is planned.

BRIEF DESCRIPTION OF THE FIGURES

The invention is described in more detail in the attached drawings, in which

FIGS. 3*a* and 3*b* are schematic representations of a situation of one hole and a hole to be drilled, respectively, in accordance with the prior art as seen from the top and as a projection displayed on a display screen, and FIGS. 4*a* to 4*f* are schematic representations of drilling situations according to the invention as seen from the top and as projections on the display.

DETAILED DESCRIPTION OF THE INVENTION

Figure 1:
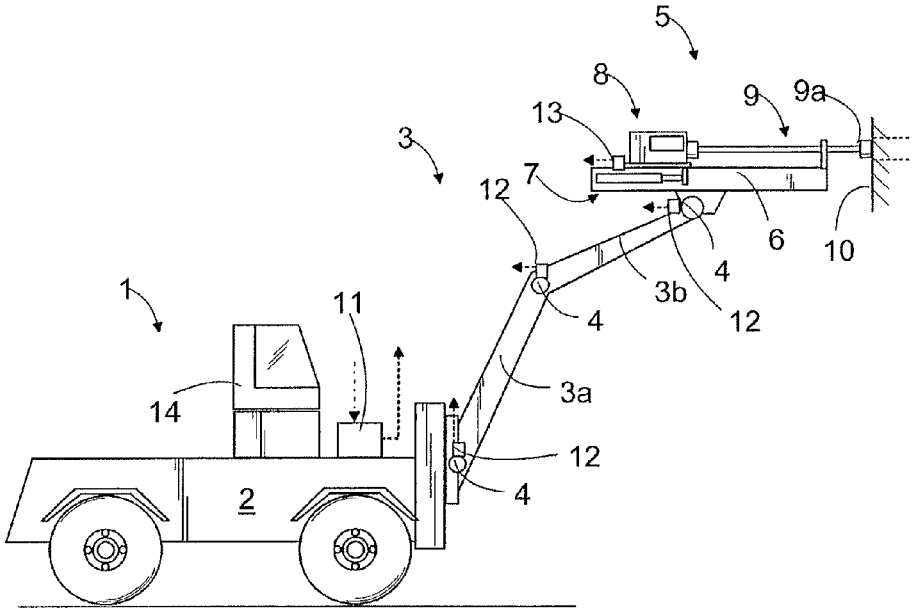
FIG. 1 is a schematic representation of a tunnel-boring device.

FIG. 1 illustrates a rock-drilling rig. It should be noted that applying the invention is not limited to any specific rock-drilling rig. The invention may also be applied to remotely controlled rock-drilling rigs, in which some of the control means of the rock-drilling rig are in a separate control room above ground, for instance. At least some of the features of the invention may then be implemented in connection with a user interface external to the rock-drilling rig and with a display belonging thereto.

The rock-drilling rig 1 shown in FIG. 1 may comprise a movable carrier 2 on which one or more drilling booms 3 are arranged. The drilling boom 3 may consist of one or more boom parts 3*a*, 3*b* that may be connected to each other and to the carrier 2 with joints 4 so that the booms 3 may be moved in a versatile manner in different directions. Further, at the free end of each drilling boom 3, there may be a drilling unit 5 that may comprise a feed beam 6, feed device 7, rock-drilling machine section 8, and drill rod 9 having a drill bit 9*a* at its outermost end. The rock-drilling machine 8 may be moved by means of the feed device 7 relative to the feed beam 6 so that the drill rod 9 maybe fed toward the rock 10 during drilling. The rock-drilling machine 8 may comprise an impact device for providing impact pulses to the tool 9 and, further, a rotating device for rotating the drill rod 9 around its longitudinal axis. The rock-drilling rig 1 also comprises control equipment 11 for controlling the drilling. The control equipment 11 may provide instructions to actuators moving the drilling boom 3 and to other actuators participating in performing the drilling operation. Further, there may be one or more sensors 12 at the joints 4 of the drilling boom 3 and one or more sensors 13 at the drilling unit 5. Measuring data received from the sensors 12, 13 may be transmitted to the control equipment 11 that may, on the basis thereof, define the location and direction of the drilling unit 5 for control purposes. The control equipment 11 may be arranged to employ the position of the drilling unit 5 as the location of the drill bit 9*a* and the direction of the longitudinal axis of the drill rod 9. It should be noted that the control equipment 11 refers generally to the control equipment of the rock-drilling rig 1 and may be formed of several sub-systems and comprise several control units, as illustrated in the following examples. Further, the rock-drilling rig usually has a control room 14 where the user of the rig is during drilling and where the necessary control and monitoring devices are located. The control room is not necessarily needed when the rig is remotely controlled, in which case the necessary control and monitoring devices are in the remote control device. The control room with its control and monitoring devices may still exist for possible manned use.

Figure 2A:
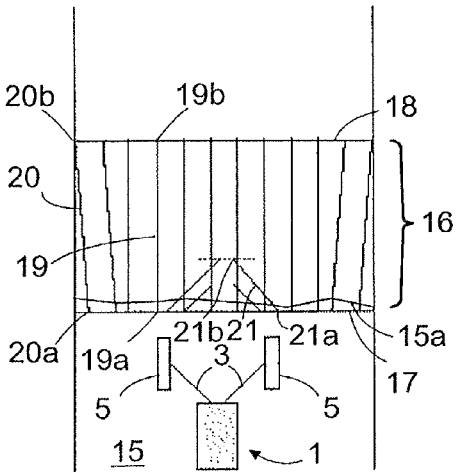
Prior Art Fig. 2a
FIGS. 2*a* and 2*b* are schematic representations of a drilling plan in a tunnel in accordance with a known projection as seen from the top and in the direction of the tunnel.
Figure 2B:
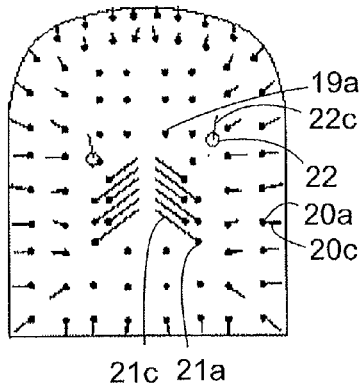
Prior Art Fig. 2b

FIGS. 2*a* and 2*b* show by way of example a prior-art projection based on an actual hole length. FIG. 2*a* is a top view of a drilling diagram in a tunnel. It has a rock-drilling rig 1 with, by way of example, two drilling booms 3 with the necessary feed beams 5 and drilling equipment. The tunnel 15 has a round defined for drilling and illustrated as a drilling plan 16. The drilling plan defines for each hole a starting point and direction in a three-dimensional coordinate system, and a length determining the end point of the hole. Alternatively, the drilling plan may define the starting and end points of the hole, which thus define the length of the hole. The drilling plan may start from a navigation plane 17, for instance, which is an imaginary plane at a distance from the rock surface 15*a*. The starting points of the holes are then defined on the navigation plane, and the lengths of the holes are defined to start from it. The holes of the round extend mainly along the length of the round, that is, until its base plane 18. If the navigation plane 17 is used, the base plane 18 is parallel to it. The drilling plan has different holes and some of them, that is, holes 19 with starting points marked with number 19*a* and end points with number 19*b*, are essentially parallel to the round. In addition, adjacent to the tunnel walls and ceiling and floor, there are obliquely outward extending holes 20 whose starting points are marked with number 20*a* and end points with number 20*b* and by means of which the tunnel is kept to a required cross-section so that it will not narrow all the time. The figure further shows how, at its starting surface side end, there are steeply obliquely drilled starting holes 21 whose starting points are marked with number 21*a* and end points with number 21*b* and by means of which the blasting is started so that the blasted stone is made to exit the blasting site.

FIG. 2*b* shows a drilling plan in the form of the tunnel profile as seen from the direction of the rock-drilling rig. Spots 19*a* to 21*a* refer to the starting points of the holes in a three-dimensional coordinate system. The drilling plan is drafted in such a manner that the drilling device begins to drill each hole from its starting point to its end point. As the directions and distance of the holes are in accordance with their actual definitions, the lines 20*c* and 21*c* that represent the direction and position of the holes and start from points 20*a* and 21*a* do not cross each other. No lines are shown for holes 19, because, according to the plan, they should be exactly parallel to the round. Thus, drilling appears clear to the user. The figure also shows the position and direction of the feed beam, whereby the position of the drill rod, that is, the starting point 22 of the drill bit is marked with a circle and, correspondingly, its length and direction with a line 22*c* starting from the circle. However, these do not reliably show to the user the relationship of the actual drilled hole and the planned hole.

FIGS. 3*a* and 3*b* are schematic representations of a problem in the known presentation method. FIG. 3*a* shows a top view of how the planned hole 20 starts from its starting point and ends at the end point of the round, in this example on the base plane 18 of the round. The starting point 20*a* of the hole 20 and its end point 20*b* are marked as black circles on a transverse plane to the drilling direction, for instance navigation plane 17 and correspondingly base plane 18. The figure further shows schematically the feed beam 5 of the rock-drilling rig, the actual hole 20' created during drilling and its starting point 20*a*' and end point 20*b*'. As FIG. 3*a* shows, the actual hole is at a significantly steeper angle relative to the navigation plane 17 and, even though its length is equal to that of the planned hole, it does not extend to the base plane 18 but remains at a distance x from it. However, when the end 20*b*' of the drilled hole 20' is approximately at the end point 20*b* of the planned hole, the result on the display of the control system of the rock-drilling rig is as shown in FIG. 3*b* when shown on the transverse projection plane, which in this case is the navigation plane 17 by way of example. Thus, the projection of the planned hole, that is, line segment 20*c*, and the line segment 20*c*' representing the projection of the actual hole created during drilling, if it was done in this situation, seem to end to each other. In situation, the user thinks she has drilled a hole until the planned end point, but in reality a distance x remains, which causes a poorer than planned blasting result.

FIGS. 4*a* to 4*f* are schematic representations of different drilling situations from the top and correspondingly as projections shown on a display in accordance with the invention.

FIG. 4*a* is a schematic representation of a situation, in which the planned hole 20 runs from the navigation plane 17 to the base plane 18. Its starting point 20*a* and correspondingly end point 20*b* are shown as circles on the planes. The feed device 5 is directed so that the starting point 20*a*' of the actual hole 20' is at a distance s from the starting point 20*a* of the planned hole. Similarly, the direction of the actual hole is at a different angle with respect to the navigation plane. As a result of this, if a hole was in reality drilled according to the original length of the hole, its end point 20*b*' would be at a distance x behind the base plane 18, which is not the intention. In FIG. 4*b*, the situation is presented as a projection on the navigation plane 17, which in this case serves as the projection plane. In it, the planned hole 20 is shown as a continuous line with the starting point 20*a* at one end and the end point 20*b* on the base plane at the other end. Correspondingly, the projection of the planned hole on the navigation plane 17 is shown as a line segment 20*c* between them. Correspondingly, the starting point 20*a*' of the actual hole to be drilled is marked with a circle and the length of the hole as a projection 20*c*' as a continuous line segment. This shows, how the line segment of the hole passes the mark 20*b*" of the base plane 18, and the projection thus shows that the hole would extend too far. In this situation, the user may shorten the hole to be drilled from the planned length so that the end of the hole would be on the base plane 18, that is, at the mark 20*b*" indicating the base plane.

FIG. 4*c*, in turn, shows a situation, in which the planned hole and the hole to be drilled are parallel to each other, but at a distance from each other. This situation is displayed in FIG. 4*d* in such a manner that the line segments 20*c* and 20*c*' representing the lengths of the planned and actual holes are the same, but the starting points 20*a* and 20*a*' and, respectively, end points 20*b* and 20*b*' of the holes have shifted in relation to each other, which indicates a transverse shift of the hole. The end 20*b*' of the actual hole is, however, as desired on the base plane 18, and therefore, the hole is acceptable.

FIGS. 4*e* and 4*f* show a situation, in which the directions of the planned hole and actual hole to be drilled differ from each other so that in reality the hole to be drilled differs from the normal of the navigation plane 17 more than the planned hole. In this situation, if a hole having the length of the planned hole were drilled, a distance x would remain between the end 20*b* of the formed hole and the base plane 18. This is shown in FIG. 4*f* in such a manner that the section between the planned hole length projection and the end point 20*b* of the planned hole on the base plane is marked with a line segment 20*d*' differing from the line segment 20*c*' representing the actual hole to be created; in this case, with a dashed line by way of example. In this situation, the user notices that the originally planned hole length is not enough and the hole length needs to be increased. This way, the actual drilled hole is made to extend to the base plane 18 and, thus, to a required location for blasting.

In FIGS. 4*b*, 4*d*, and 4*f*, the symbols of the planned hole and actual hole are shown on top of each other in elevation so as to distinguish them better from each other. In theory, they should be on the same line, if they are at the same location in elevation. In practice, they are shown to be at the same location, but different colours or line segments are used for them so as to distinguish them from each other. The symbols representing the starting and end points of the holes may be freely selected. Similarly, different line segment types and thicknesses may be selected as required as long as the result is clear to the user and easily viewable. The figures also show the base plane intersections of the hole to be created or its extension and the planned hole on a diamond 20*b*". These indicate that the hole to be created in the case depicted by FIGS. 4*a* and 4*b* would become too long and needs to be shortened. Correspondingly, the hole to be created in the case depicted by FIGS. 4*e* and 4*f* would become too short and needs to be lengthened.

In the above description and in the drawings, the invention is described by way of example only and is not in any way restricted to them. The essential thing is that when projecting the position of a hole to be drilled, the position of its end point formed on the basis of its planned length relative to the base plane of the round is presented in such a manner that the user sees from the projection, whether the end point of the hole to be drilled is on the base plane or whether it differs to either side of the base plane, so that the user may, if necessary, correct the drilling to correspond to the desired target, that is, ending the hole on the base plane. In all situations, it is naturally also possible to direct the drill rod and move its starting point in the transverse direction so that the projection of the planned hole and the projection of the hole to be created in drilling and the starting point and end point are completely on top of each other. This way, the hole is drilled in exactly its planned location. However, this is not always possible and then the required end point may be achieved by means of the invention regardless of the difference in the starting points. The projection plane may be any transverse plane to the longitudinal direction of the round, on which different projections may be defined. The projection plane is most preferably essentially perpendicular to the longitudinal direction of the round and thus also to the longitudinal direction of most of the holes. Because all holes are not parallel, it cannot be perpendicular to the longitudinal direction of all holes. The projection plane may be the earlier mentioned navigation plane, but it may also differ from it and be non-parallel to it. Similarly, the starting points of the holes need not be on the projection plane. When defining the projection, the plane extending through the planned end point of the hole is used for each hole, and all these planes are parallel to the base plane of the round. They may be the same as the base plane of the round or they may be at a distance from it depending on the end point of the hole. In practice, in most cases the base plane of parallel holes in the middle of the round is the same as the base plane of the round, but on the edges and in cutholes, the base plane differs from the base plane of the round.

The invention claimed is:

1. A method for displaying holes to be drilled when drilling holes into rock with a rock-drilling rig having control equipment and a display belonging thereto, and measuring means for defining the direction and position of the drill rod, by using a pre-designed drilling plan that is defined using a three-dimensional set of coordinates relative to the rock and that defines for each hole to be drilled a starting point and an end point in accordance with the direction of each planned hole, and in which method, for drilling a hole, a projection according to the drilling plan of the planned hole is displayed on the display of the control equipment on a transverse projection plane of the holes to be drilled, and a projection of the hole created when drilling according to the current position of the drill rod on said projection plane in accordance with a target length set for the hole, comprising a) defining for each hole a base plane running through the end point of the hole and parallel to the projection plane and b) displaying on a display a first graphical locating symbol representing an intersection point between the base plane and the projection of the hole created when drilling according to the current position of the drill rod, and c) displaying on the display a representation of any difference between the first graphical locating symbol and an end point of the hole created when drilling according to the current position of the drill rod.

2. A method as claimed in claim 1, comprising directing the drill rod until the end point of the planned hole and the first graphical locating symbol are on top of each other on the display, if the intersection of the projection of the hole created during drilling or its parallel extension and the base plane differ from the end point of the planned hole.

3. A method as claimed in claim 2, comprising altering the drill length of the hole to be created during drilling so that its projection on the display ends at said intersection, if after directing, the end point of the projection of the hole created during drilling is not at the same point as the end point of the planned hole.

4. A method as claimed in claim 1, comprising defining a second graphical location symbol at the end point of the planned hole.

5. A method as claimed in claim 4, comprising using symbols of similar shape and size as the first and second graphical location symbols.

6. A method as claimed in claim 4, comprising presenting the projection of the line segment between the first graphical locating symbol and the end point as a line segment differing from the line segment representing the actual hole, when the end point of the hole created when drilling in accordance with the current location of the drill rod is at a distance from the intersection of the hole extension and base plane.

7. A method as claimed in claim 4, comprising altering the direction and length of the hole created during drilling automatically in such a manner that the base plane of the hole planned in the drilling plan is reached.

8. A method as claimed in claim 4, comprising using as the projection plane for all holes in the drilling plan a common navigation plane into which the starting points of all holes are defined.

9. A method as claimed in claim 1, comprising presenting the projection of the line segment between the first graphical locating symbol and the end point as a line segment differing from the line segment representing the actual hole, when the end point of the hole created when drilling in accordance with the current location of the drill rod is at a distance from the intersection of the hole extension and base plane.

10. A method as claimed in claim 1, comprising altering the direction and length of the hole created during drilling automatically in such a manner that the base plane of the hole planned in the drilling plan is reached.

11. A method as claimed in claim 1, comprising using as the projection plane for all holes in the drilling plan a common navigation plane into which the starting points of all holes are defined.

12. A method for directing a drill rod when drilling holes into rock with a rock-drilling rig having control equipment and a display belonging thereto, and measuring means for defining the direction and position of the drill rod, by using a pre-designed drilling plan that is defined using a three-dimensional set of coordinates relative to the rock, the method defining for each hole to be drilled in the coordinate system a starting point and an end point in accordance with the direction and length of each planned hole and, for drilling the hole, a projection of the planned hole is displayed on the display of the control equipment as a line segment on the transverse projection plane of the holes and, correspondingly, a projection of the actual hole created when drilling according to the current position of the drill rod as a line segment on said projection plane when drilling in accordance with a target length set for the hole, comprising a) defining for each hole a base plane running through the end point of the hole and parallel to the projection plane, b) displaying on a display a first graphical locating symbol representing an intersection point between the base plane and the projection of the hole created when drilling according to the current position of the drill rod, and displaying on the display a representation of any difference between the first graphical locating symbol and an end point of the hole created when drilling according to the current position of the drill rod, and c) performing one or both of the following operations, if the intersection of the projection of the hole created during drilling or the parallel extension thereof and the base plane differs from the end point of the planned hole, d) directing the drill rod until said end point of the planned hole and the first graphical locating symbol are at the same place, e) altering the drilling length of the hole created during drilling so that it ends at the first graphical locating symbol on the display.

13. A method as claimed in claim 12, comprising using as the projection plane for all holes in the drilling plan a common navigation plane into which the starting points of all holes are defined.

14. A method as claimed in claim 12, comprising defining a second graphical location symbol at the end point of the planned hole.

15. A method as claimed in claim 14, wherein the second graphical location symbol and the first graphical location symbol are of the same shape and size.

16. A method as claimed in claim 12, comprising presenting the projection of the line segment between the first graphical locating symbol and the end point as a line segment differing from the line segment representing the actual hole, when the end point of the hole created when drilling in accordance with the current location of the drill rod is at a distance from the intersection of the hole extension and base plane.

17. A method as claimed in claim 12, comprising altering the direction and length of the hole created during drilling automatically in such a manner that the base plane of the hole planned in the drilling plan is reached.

18. Equipment for displaying drill holes when drilling holes into rock with a rock-drilling rig having control equipment and a display belonging thereto, and measuring means for defining the direction and position of the drill rod, by using a pre-designed drilling plan that is defined using a three-dimensional coordinate system relative to the rock and that defines for each hole to be drilled in the coordinate system a starting point and an end point in accordance with the planned direction and length of each hole, and display means for displaying on the display of the control equipment a projection of the planned hole as a line segment on the transverse projection plane of the holes and, correspondingly, a projection of the actual hole created when drilling according to the current position of the drill rod as a line segment on said projection plane when drilling in accordance with a target length set for the hole, wherein the display means are arranged to a) define for each hole a base plane running through the end point of the hole and parallel to the projection plane, b) display on a display a first graphical locating symbol representing an intersection point between the base plane and the projection of the hole created when drilling according to the current position of the drill rod, and c) display on the display a representation of any difference between the first graphical locating symbol and an end point of the hole created when drilling according to the current position of the drill rod.

19. Equipment as claimed in claim 18, wherein the display means are arranged to display a second graphical location symbol at the end point of the planned hole.

20. Equipment as claimed in claim 19, wherein the display means are arranged to display symbols of similar shape and size for both the first and the second graphical location symbols.

21. Equipment as claimed in claim 18, wherein when drilling in accordance with the current location of the drill rod and when the end point of the hole to be created during drilling is at a distance from the intersection of the hole extension and base plane, the display means are arranged to display the projection of the line segment between the first graphical locating symbol and the end point as a line segment differing from the line segment representing the actual hole.

22. Equipment as claimed in claim 18, wherein the display means are arranged to use as the projection plane for all holes in the drilling plan a common navigation plane into which the starting points of all holes are defined.

* * * * *